US010804020B2

(12) United States Patent
Klapper

(10) Patent No.: US 10,804,020 B2
(45) Date of Patent: Oct. 13, 2020

(54) DEMAGNETIZATION DEVICE AND METHOD FOR DEMAGNETIZING A TRANSFORMER CORE

(71) Applicant: OMICRON ELECTRONICS GMBH, Klaus (AT)

(72) Inventor: Ulrich Klapper, Rankweil (AT)

(73) Assignee: OMICRON ELECTRONICS GMBH, Klaus (AT)

( * ) Notice: Subject to any disclaimer, the term of this patent is extended or adjusted under 35 U.S.C. 154(b) by 219 days.

(21) Appl. No.: 15/534,428

(22) PCT Filed: Dec. 9, 2015

(86) PCT No.: PCT/EP2015/079087
§ 371 (c)(1),
(2) Date: Jun. 8, 2017

(87) PCT Pub. No.: WO2016/091932
PCT Pub. Date: Jun. 16, 2016

(65) Prior Publication Data

US 2018/0261368 A1 Sep. 13, 2018

(30) Foreign Application Priority Data

Dec. 9, 2014 (AT) ..... 50892/2014.9

(51) Int. Cl.
*H01F 13/00* (2006.01)
*H01F 38/32* (2006.01)

(52) U.S. Cl.
CPC ..... *H01F 13/006* (2013.01); *H01F 38/32* (2013.01)

(58) Field of Classification Search
CPC ..... H01F 13/006; H01F 38/32
USPC ..... 361/143
See application file for complete search history.

(56) References Cited

U.S. PATENT DOCUMENTS 3,859,573 A 1/1975 Siems et al.
4,280,162 A * 7/1981 Tanka ..... H02H 3/332 324/117 R
6,160,697 A * 12/2000 Edel ..... G01R 15/185 361/143
6,522,517 B1 2/2003 Edel
2002/0070720 A1* 6/2002 L'Hermite ..... H02M 3/33507 323/284

(Continued)

FOREIGN PATENT DOCUMENTS

CN 203659568 U 6/2014
DE 3511710 A1 10/1986

(Continued)

OTHER PUBLICATIONS

Chrisite, John, "Improvement relating to electrical switchgear", Feb. 20, 1957 (Year: 1954).*

(Continued)

*Primary Examiner* — Kevin J Comber
(74) *Attorney, Agent, or Firm* — Mintz Levin Cohn Ferris Glovsky and Popeo, P.C.; Peter F. Corless; Steven M. Jensen

(57) ABSTRACT

In order to demagnetize a transformer core (13, 23) a demagnetization device (40) is detachably connected to a primary side (11) of a transformer (10, 20). An alternating signal is fed to the primary side (11) in order to demagnetize the transformer (10, 20).

18 Claims, 7 Drawing Sheets

(56) References Cited

U.S. PATENT DOCUMENTS

2007/0115603 A1 5/2007 Maurer

FOREIGN PATENT DOCUMENTS

| | | | |
|---|---|---|---|
| JP | H09 223628 | A | 8/1997 |
| RU | 97108400 | A | 5/1999 |
| RU | 2148292 | C1 | 4/2000 |

OTHER PUBLICATIONS

English-language translation of Search Report issued in Russian Application No. 2017123870 dated Jun. 13, 2018.
Putter et al., "Reliable demagnetization of transformer cores", OMICRON, Apr. 2014.
Three-Phase Transformer Demagnetizer DEM60C. Datasheet [online]. DV Power, Version Oct. 20, 2014.
Office Action issued in Indian Application No. 201717020124 dated May 28, 2019.

* cited by examiner

DEMAGNETIZATION DEVICE AND METHOD FOR DEMAGNETIZING A TRANSFORMER CORE

CROSS-REFERENCE TO RELATED APPLICATION

This application is a National Phase application filed under 35 U.S.C. § 371 of PCT International Application No. PCT/EP2015/079087 with an International Filing Date of Dec. 9, 2015, which claims under 35 U.S.C. § 119(a) the benefit of Austrian Application No. 50892/2014.9, filed Dec. 9, 2014, the entire contents of which are incorporated herein by reference.

FIELD OF THE INVENTION

The invention relates to a demagnetization device and a method for demagnetizing transformer cores. The invention specifically relates to devices and methods for the demagnetization of transformer cores which can be employed if, during the testing of a switch, a transformer or another electrical engineering element, a direct current is applied which can result in the magnetization of transformer cores.

BACKGROUND

Transformers are installed in many electrical engineering installations. Examples of transformers of this type are current transformers. Current transformers can be protective transformers, the function of which, even in the event of a malfunction, can be the transmission of information on current in a primary system to secondary engineering installations, for example to protective relays. However, current transformers can also be instrument transformers which, in normal operation, transmit information on currents in the primary system. Examples of secondary engineering systems of this type include measuring devices or indicators in an instrumentation and control system.

Current transformers can be configured as transformers, in which a primary conductor, for example a conductor rail, is routed through a current transformer. A plurality of secondary-side windings can be wound onto a transformer core. In many cases, a plurality of transformer cores, and a plurality of secondary windings wound thereupon, are also employed, wherein the plurality of transformers share a common primary conductor.

In normal duty, the transformer cores of current transformers are only magnetized to a very partial extent. This applies specifically to protective transformers. If a transformer core is polarized, the transformer can be brought to a state of saturation by a fault current. For example, a situation of this type can occur if, for the testing of a switch or another electrical engineering facility, a current is applied to the primary conductor, and the core is polarized as a result. This entails the risk that fault currents can no longer be reliably detected. Protective devices, for example protective relays, which are connected to the secondary side of the transformer can, in the event of a malfunction, be tripped with a time delay, or not at all, thereby resulting in substantial damage.

SUMMARY OF THE INVENTION

There is a need for devices and methods, by means of which the operational reliability of electrical engineering facilities can be improved. Specifically, there is a need for devices and methods which can reduce of the risk whereby a transformer, as a result of polarization, rapidly achieves saturation and fault currents cannot be detected, or are detected late, further to the execution of a test on an electrical engineering facility.

According to exemplary embodiments, devices, systems and methods are disclosed for the demagnetization of a transformer core of a transformer. To this end, an alternating signal is fed to a primary side of the transformer. A frequency and/or amplitude of the alternating signal can be varied as a function of time.

Various effects can be achieved by the devices and methods according to the exemplary embodiments. Given that, in a dead-tank circuit-breaker, the switch itself cannot be checked without magnetizing the transformer core of the current transformer, demagnetization is particularly important in this case.

Where a plurality of transformers which share the same primary conductor are connected in series, the transformer cores of all the series-connected transformers can be demagnetized simultaneously. It is not necessary for the secondary terminals of all the series-connected transformers to be made accessible, in order to demagnetize the transformer cores of the plurality of transformers.

The alternating signal can, for example, be a sinusoidal signal, a square-wave signal, a triangular signal or another signal with polarity reversal.

The alternating signal can be an alternating voltage or an alternating current.

The devices and methods can be configured such that, for demagnetization, an alternating signal is only applied to the primary side of the transformer.

The "demagnetization" of the transformer core is to be understood here as a process whereby the magnetization of the transformer core in a de-energized state, also described as remanence, is reduced. It is possible, but not necessary, for the transformer core to be completely demagnetized.

A demagnetization device according to one exemplary embodiment comprises terminals for the detachable connection of the demagnetization device to a primary side of a transformer. The demagnetization device comprises a source, which is designed, for the demagnetization of a transformer core of the transformer, to feed an alternating signal to the primary side of the transformer via the terminals.

The demagnetization device can be configured as an apparatus with a housing, in which the source is arranged.

The demagnetization device can be configured as a mobile apparatus. The demagnetization device can be configured as a portable apparatus.

The demagnetization device can be designed, for the demagnetization of the transformer core, to vary an amplitude and/or a frequency of the alternating signal as a function of time.

The demagnetization device can be designed, for the demagnetization of the transformer core, to reduce the amplitude of the alternating signal as a function of time, and/or to increase the frequency of the alternating signal as a function of time.

The demagnetization device can be designed, for the demagnetization of the transformer core, to generate the alternating signal such that a time integral of a magnitude of the alternating signal determined between two times, at which two sequential polarity reversals of the alternating signal are executed, is varied as a function of time.

The alternating signal can, at a first time and a second time, undergo directly sequential polarity reversals. The alternating signal can, at a third time and a fourth time, undergo further directly sequential polarity reversals, wherein the third time is later than the first time. The demagnetization device can be designed to vary the alternating signal as a function of time, such that the time integral of the magnitude of the alternating signal between the first time and the second time is greater than the time integral of the magnitude of the alternating signal between the third time and the fourth time.

The demagnetization device can be designed, for the demagnetization of the transformer core, to generate the alternating signal such that the time integral decreases.

The demagnetization device can comprise a measuring device for the detection of a response of the transformer to the alternating signal. The demagnetization device can be designed to vary the alternating signal in accordance with the response detected by the measuring device.

The transformer and at least one further transformer can share a common primary conductor. The demagnetization device can comprise a measuring device for the detection of a response of the transformer and of the at least one further transformer to the alternating signal.

The alternating signal can be an alternating voltage. The response can be a current which flows through the primary side.

The alternating current can be an alternating current. The response can be a voltage, which drops across the primary side.

The demagnetization device can be designed to vary the alternating signal in accordance with the response detected by the measuring device.

The demagnetization device can be designed to determine an amplitude variation and/or a frequency variation of the alternating signal in accordance with the response detected by the measuring device.

The demagnetization device can be designed to detect the demagnetization of the transformer core in accordance with the response detected by the measuring device.

The measuring device can be connectable to the primary side of the transformer.

The demagnetization device can be designed for the execution of demagnetization, without being connected to a secondary side of the transformer in a conductive manner. Where the demagnetization device demagnetizes a plurality of transformers simultaneously, the demagnetization device can be designed for the execution of demagnetization, without being connected to a secondary side of any one of the plurality of transformers in a conductive manner.

The demagnetization device can be designed for the execution of a resistance measurement on the primary side of the transformer and, for the demagnetization of the transformer core further to the completion of the resistance measurement, for the infeed of the alternating signal to the primary side of the transformer. The demagnetization device can be designed for the automatic execution of demagnetization, further to the resistance measurement. The resistance measurement can be a microohmic measurement. The resistance measurement can be executed as a four-point measurement.

A system according to one exemplary embodiment comprises a transformer, having a primary side, a secondary side and a transformer core. The system comprises a demagnetization device according to one exemplary embodiment.

The demagnetization device can only be connected to the primary side of the transformer.

The transformer can be a protective transformer. The transformer can be a protective transformer which is configured as a current transformer.

The system can comprise a protective device for an electricity system, which is connected to the secondary side of the transformer. The protective device can be a protective relay.

The transformer can be arranged in a bushing. The transformer can be a bushing-type current transformer of a dead-tank circuit-breaker.

The transformer can be arranged in a gas-insulated switchgear (GIS) installation.

A method for the demagnetization of a transformer comprises the connection of a demagnetization device to a primary side of the transformer, and the demagnetization of a transformer core of the transformer. For the demagnetization of the transformer core, the demagnetization device generates an alternating signal, which is fed to the primary side of the transformer.

For the demagnetization of the transformer core, an amplitude and/or a frequency of the alternating signal can be varied as a function of time.

For the demagnetization of the transformer core, the amplitude of the alternating signal can be reduced as a function of time. Alternatively or additionally, for the demagnetization of the transformer core, the frequency of the alternating signal can be increased as a function of time.

The alternating signal can be generated such that a time integral of a magnitude of the alternating signal determined between two times, at which two sequential polarity reversals of the alternating signal are executed, is varied as a function of time.

The alternating signal can, at a first time and a second time, undergo directly sequential polarity reversals. The alternating signal can, at a third time and a fourth time, undergo further directly sequential polarity reversals, wherein the third time is later than the first time. The alternating signal can be varied as a function of time, such that the time integral of the magnitude of the alternating signal between the first time and the second time is greater than the time integral of the magnitude of the alternating signal between the third time and the fourth time.

The method can comprise the detection of a response to the alternating signal. The response can be a response of the transformer to the alternating signal. The response can be a response of the transformer and of at least one further transformer, which share a common primary conductor, to the alternating signal.

The method can comprise a time-dependent variation of the alternating signal, in accordance with the response.

The alternating signal can be an alternating current, and the response can comprise a voltage.

The alternating signal can be an alternating voltage, and the response can comprise a current.

An amplitude variation and/or a frequency variation of the alternating signal can be determined in accordance with the response detected.

The demagnetization device can only be connected to the primary side of the transformer.

The transformer can be arranged in a bushing. The transformer can be a bushing-type current transformer of a dead-tank circuit-breaker.

The transformer can be a protective transformer. The transformer can be a current transformer, which is configured as a protective transformer.

A protective device of an electricity system can be connected to the secondary side of the transformer. The protective device can be a protective relay.

The method can executed using the demagnetization device or the system according to one exemplary embodiment.

In the case of devices, systems and methods according to exemplary embodiments, a transformer core of a transformer can be demagnetized, without the requirement for access to the secondary side of the transformer for this purpose. A plurality of transformers, which share a common primary conductor, can be demagnetized in a simple manner. Variations in the alternating signal can be matched to a response of the transformer to the alternating signal, or to a response of a plurality of transformers to the alternating signal, in order to permit the effective execution of demagnetization.

Devices, methods and systems according to exemplary embodiments reduce the risk that, after a test procedure, transformers will have strongly-magnetized transformer cores. The risk that fault currents will not be reliably detected can be reduced.

BRIEF DESCRIPTION OF THE FIGURES

The invention is described in greater detail hereinafter with reference to the drawings, with respect to preferred exemplary embodiments. In the drawings, identical elements are identified by identical reference symbols.

DETAILED DESCRIPTION OF EXEMPLARY EMBODIMENTS

The present invention is described in greater detail hereinafter, with respect to preferred forms of embodiment and with reference to the drawings. In the figures, identical reference symbols represent identical or similar elements. The figures are schematic representations of different forms of embodiment of the invention. Elements represented in the figures are not necessarily represented true to scale. Rather, the various elements presented in the figures are represented in a manner which will make their function and purpose clear to a person skilled in the art.

Connections and couplings represented in the figures between functional units and elements can also be deployed as an indirect connection or coupling. A connection or coupling can be deployed in a wired or wireless form.

Devices and methods are described hereinafter, by means of which a transformer core can be demagnetized. To this end, from a device which can be connected to the primary side of the transformer in a detachable manner, an alternating signal is fed to the primary side. The alternating signal is varied as a function of time, in order to demagnetize the transformer core. By means of the devices and methods, a plurality of transformer cores can also be simultaneously demagnetized, wherein the alternating signal is applied to a primary conductor which is common to a plurality of transformers.

As will be described in greater detail, a frequency and/or an amplitude of the alternating signal can be varied as a function of time, in order to demagnetize the transformer core. The frequency of the alternating signal can be increased. The amplitude of the alternating signal can be reduced. Frequency variations and/or amplitude variations of the alternating signal can be generated in accordance with a response to the alternating signal, wherein the response on the primary side of the transformer can be detected. In this way, the magnetization of the transformer core can be reduced in a more efficient and more reliable manner.

The transformer can be a protective transformer. A primary side can be a conductor in a primary system of an electricity network, a power plant or a transformer substation. The secondary side of the transformer or, in the event that a plurality of transformers are present, the secondary sides of the plurality of transformers can be coupled to a protective device of a secondary system. By means of the methods and devices, the transformer cores can, for example, be demagnetized after the testing of a component in the primary system of the electricity network such that fault currents can be reliably detected, without the necessity for the formation of electrically-conductive connections to the secondary side of the transformer or transformers for the purposes of demagnetization.

Figure 1:
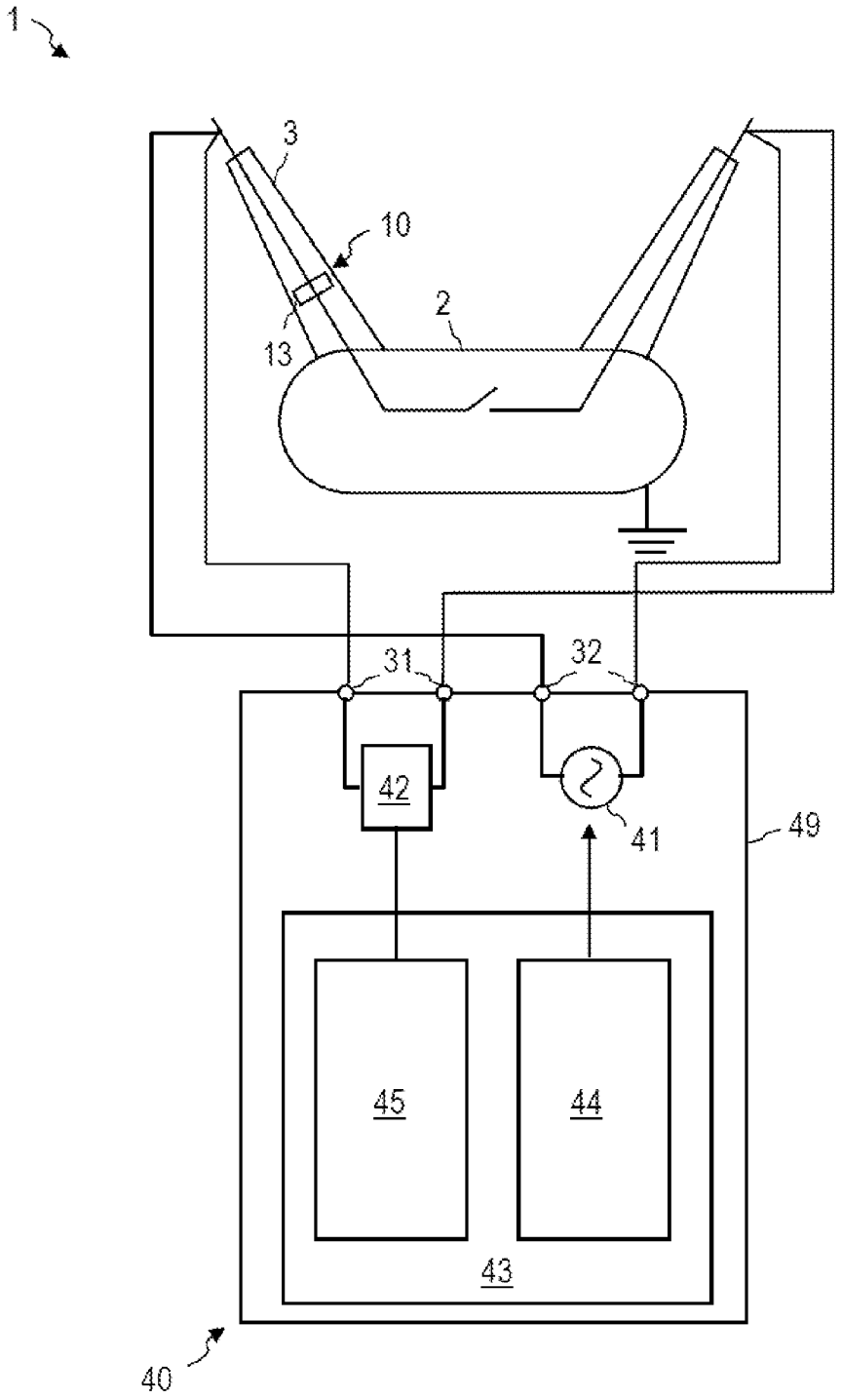
FIG. 1 shows a system with a device according to one exemplary embodiment.

FIG. 1 shows a system 1 with a device 40 according to one exemplary embodiment. The device 40 is a demagnetization device. The device 40 can be a mobile apparatus, specifically a portable apparatus. The device 40 can be designed for detachable connection to a conductor on a primary side of a transformer. The device 40 can be designed for the execution of both a procedure for the testing of a component of an electricity system, and a procedure for the demagnetization of a transformer core, which is described in greater detail hereinafter.

The system 1 comprises a component 2 of an electricity system. The component 2 can be a switch. The component 2 can be a switch for high- or medium-voltage networks. The switch can be a switch which is installed in a power plant or a transformer substation. A dead-tank circuit-breaker, having bushings 3, is represented for exemplary purposes. The device 40 can also be employed in combination with other switches or other facilities of a power plant, a transformer substation or a supply network, which incorporate one or more transformers.

Dead-tank circuit-breakers can incorporate the bushings 3, in which one or more current transformers 10 are installed. A current transformer 10 can incorporate a transformer core 13. If the switch is checked by the device 40, or by a test apparatus which is separate from the device 40, by means of a micro-ohmic measurement, a direct current can be applied until such time as the transformer or the transformers in the bushings 3 are in a fully-saturated state, such that the result of the micro-ohmic measurement is no longer influenced by the transformer or transformers 10. By means of the devices and methods described in detail hereinafter, the transformer core or transformer cores can be demagnetized in a simple manner, wherein an alternating signal is applied to the primary side. Any access to the secondary side, for the purposes of demagnetization, can be avoided. This reduces operating expenditure, as no access to the secondary sides of transformers needs to be provided, and the current transformers also do not need to be recommissioned in order to demagnetize the transformer core or transformer cores.

The device 40 comprises a plurality of terminals 31, 32 and a source 41 for an alternating signal. The alternating signal can be applied or injected into a primary conductor of the converter 10 or the plurality of converters. The source 41 can be a current source, which can be controlled for the generation of a direct current and/or an alternating current. The source 41 can be controlled for the generation of alternating currents at a plurality of different frequencies. The source 41 can be a voltage source, which can be controlled for the generation of a direct voltage and/or an alternating voltage as a signal. The source 41 can be controlled for the generation of alternating voltages at a plurality of different frequencies.

The device 40 can comprise further facilities, for example one or a plurality of measuring devices 42 for the detection of a response as a reaction to the alternating signal. The device 40 can comprise a control device 44 for the automatic electrical control of the source 41. The device 40 can comprise an evaluation device 45 for the evaluation of a response of the transformer 10, which is detected by means of the measuring devices 42.

The control device 44 and the evaluation device 45 can be deployed by an integrated semiconductor circuit 43 or a plurality of integrated semiconductor circuits 43. The integrated semiconductor circuit 43 can comprise a controller, a microcontroller, a processor, a microprocessor, an application-specific special circuit or a combination of the aforementioned components.

The control device 44 can be designed to control the source 41 such that the alternating signal is varied as a function of time. A frequency of the alternating signal can be increased and/or an amplitude of the alternating signal can be reduced. The timings and/or magnitude of frequency variations and/or of amplitude variations can be determined in accordance with a response which is detected by the measuring device 42.

By means of the device 40, an alternating signal, which can be an alternating current or an alternating voltage, with a variable frequency and/or a variable amplitude, is injected into the primary side of the current transformer 10. The primary side of the transformer 10, which is the high-current side, can be a solid conductor or a conductor rail, which is routed once or a plurality of times through a transformer core, on which the secondary winding is wound. The execution of demagnetization from this primary side is possible. In this case, either the frequency or the amplitude of the alternating signal is varied. The lower the frequency and/or the greater the amplitude of the alternating signal, the greater the saturation of the transformer core 13 or transformers cores, as the voltage-time area of a half-wave increases respectively with a lower frequency and a greater amplitude. The source 41 can be controlled such that the voltage-time area on the core is gradually reduced, for example wherein the frequency is increased and/or the amplitude is reduced, as will be described in greater detail.

If the primary conductor is routed through the transformer cores of a plurality of transformers, and the plurality of transformer cores are thus so to speak arranged in series, the plurality of transformer cores can be demagnetized simultaneously. In many cases, on one conductor rail or in one transformer housing, a plurality of current transformers are arranged, which are thus connected in series on the primary side, but can be connected in an entirely independent manner on the secondary side. By the method described, all these transformers can be demagnetized by a single connection and a single demagnetization process.

The source 41 can have various configurations. The source 41 can be designed to generate an alternating signal with a sinusoidal signal shape. The source 41 can be designed to generate an alternating signal with a triangular signal shape, for example a sawtooth signal. The source 41 can be designed for the generation of an alternating direct current or an alternating direct voltage. The alternating signal can be a current which is injected into the primary side. The alternating signal can be a voltage which is applied to the primary side.

The measuring device 42 can be designed to detect the voltage generated on the transformer or on the series-connected arrangement of transformers by the injection of alternating current. On the basis of the voltage detected, the evaluation device 45 can determine at which frequency each transformer achieves saturation. The frequency and/or the amplitude of the alternating signal can be varied according. As a result, effective demagnetization can be achieved in a short time.

The measuring device 42 can be designed to detect the current generated on the transformer or on the series-connected arrangement of transformers by the alternating voltage applied. On the basis of the current detected, the evaluation device 45 can determine at which frequency each transformer achieves saturation. The frequency and/or the amplitude of the alternating signal can be varied accordingly. As a result, effective demagnetization can be achieved in a short time.

The secondary winding of the transformer, or the secondary windings of the plurality of transformers and the devices connected thereto, including protective relays, measuring devices or metering devices, together with the instrumentation and control system, must not be affected by the demagnetization of the transformer.

As represented in FIG. 1, devices and methods according to exemplary embodiments for the demagnetization of transformers which are installed in a bushing 3 of a switch can be employed. The devices and methods can be employed for the simultaneous demagnetization of a plurality of protective transformers, without the necessity for access to the secondary sides of protective transformers for this purpose. The devices and methods are not restricted to this application.

Figure 2:
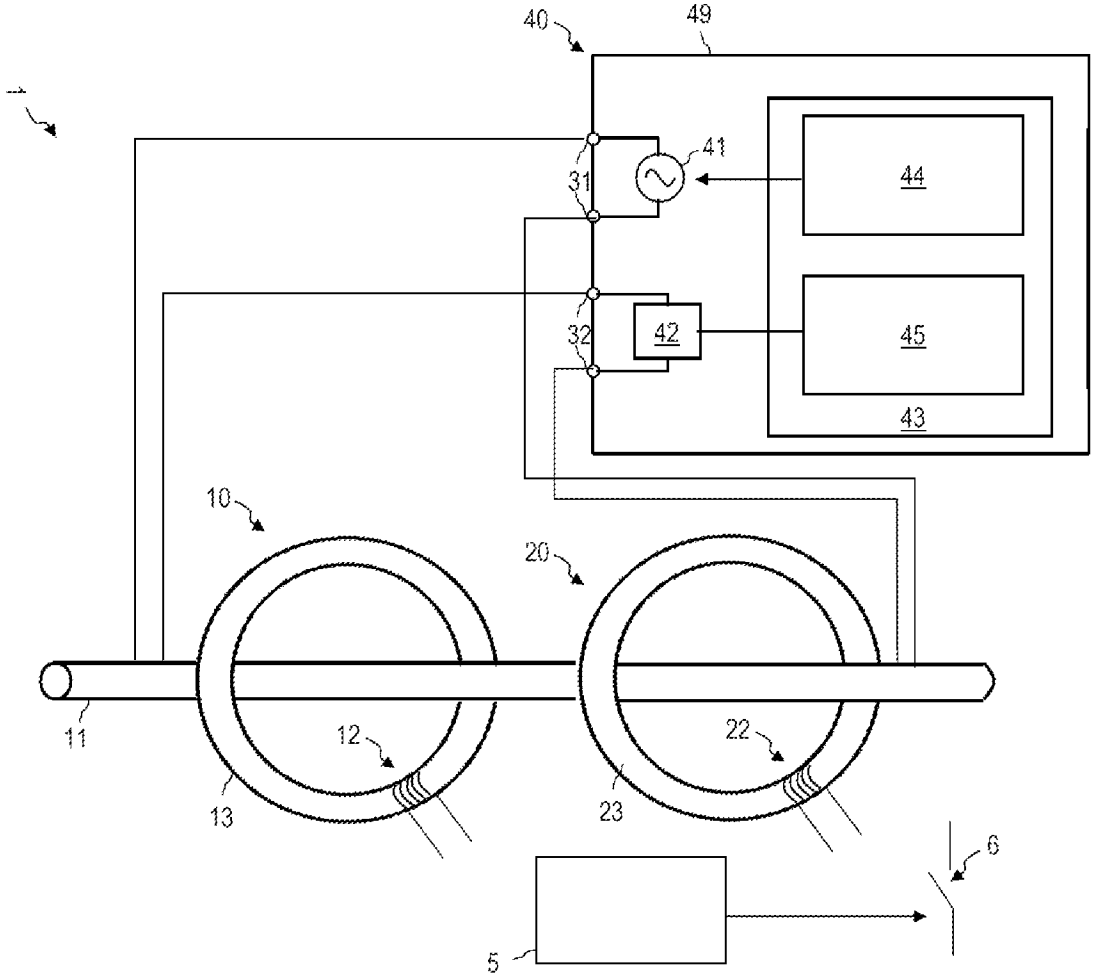
FIG. 2 shows a system with a device according to one exemplary embodiment.

FIG. 2 represents a system 1 having a device 40 according to a further exemplary embodiment. The device 40 is designed for the simultaneous demagnetization of a plurality of transformer cores.

The system 1 comprises a transformer 10 and at least one further transformer 20. The plurality of transformers 10, 20 can be a plurality of protective transformers, which are installed in the same bushing or in different bushings of a dead-tank circuit-breaker or in another electrical engineering facility.

A primary conductor 11, which can be configured as a conductor rail or as another solid conductor, forms the primary side of the first transformer 10 and the second transformer 20. A secondary winding 12 of the transformer 10 is inductively coupled to the primary conductor 11. The secondary winding 12 can be wound onto a transformer core 13 of the transformer 10. The transformer core 13 can be an iron core. A further secondary winding 22 of the further transformer 20 is inductively coupled to the primary conductor 11. The further secondary winding 22 can be wound onto a further transformer core 23 of the further transformer 20. The further transformer core 23 can be an iron core.

The primary conductor 11 can be rated for higher currents than the secondary windings 12, 22. The primary conductor 11 can constitute the high-current side, in which higher currents flow than in the secondary windings 12, 22.

The series-connected arrangement, as represented in FIG. 2, can also comprise more than two transformers 10, 20. For example, the device 40 can be employed for the simultaneous demagnetization of the transformer cores of the plurality of transformers in a series-connected arrangement of two, three or more than three transformers. To this end, the device 40 can generate an alternating voltage, which is applied to the primary conductor which is common to the plurality of transformers, and can be routed through the transformer cores of the plurality of transformers. The device 40 can vary the amplitude and/or frequency of the alternating voltage as a function of time, in order to permit the simultaneous demagnetization of a plurality of transformer cores. The device 40 can generate an alternating current, which is injected into the primary conductor which is common to the plurality of transformers, and can be routed through the transformers cores of the plurality of transformers. The device 40 can vary the amplitude and/or frequency of the alternating current as a function of time, in order to permit the simultaneous demagnetization of a plurality of transformer cores.

The system can comprise a protective device 5, for example a protective relay, and/or an instrumentation and control system indicator. One or more of the secondary windings 12, 22 can be connected to a protective device 5 on the electricity system. One or more of the secondary windings 12, 22 can be connected to the instrumentation and control system indicator. The system can comprise a switch 6 on the primary system. The switch 6 can, for example, be a switch with a quenching gas, e.g. a self-blast circuit-breaker, or another switch. The protective device 5 can trip the switch 6 in response to a fault current which is detected by means of one of the transformers 10, 20 or a plurality of the transformers 10, 20.

Figure 3:
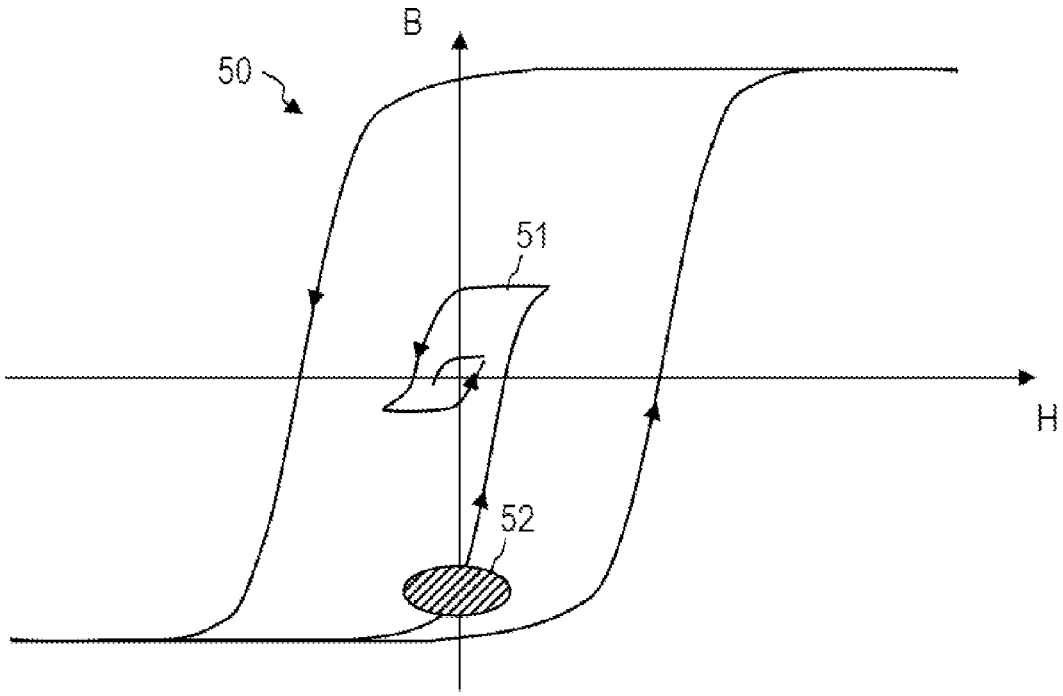
FIG. 3 shows a diagram for the illustration of the mode of operation of devices and methods according to exemplary embodiments.

FIG. 3 shows a hysteresis curve 50 of a transformer core, which can be demagnetized by means of devices and methods according to exemplary embodiments. The magnetic flux density is represented as a function of magnetic field strength.

If, in the event of a resistance measurement of the primary conductor 11, or another test, a higher current flows through the primary conductor 11, which can be injected by the device 40, the transformer core is magnetized. As a result of the high current strengths which may flow in the case of such tests, the transformer can achieve saturation, and will have a high remanence when the test is completed.

If the transformer core has such a remanence further to a test, in which a high current is injected into the primary conductor 11, the transformer core can be located, for example, in a region 52 of the diagram 50.

As a result of the magnetization of the transformer core, fault currents cannot always be detected, or cannot always detected with sufficient speed.

By the injection of an alternating signal, the frequency and/or amplitude of which can be controlled or regulated by the device 40, the transformer core can be demagnetized. The transformer core can thus pass through a path 51 in the hysteresis diagram, in which magnetization is reduced. The transformer core can be demagnetized, in order to restore the reliable detection of fault currents.

In a series-connected arrangement of a plurality of transformers, in which a primary conductor 11 is routed through a plurality of transformer cores, the plurality of transformer cores can be demagnetized simultaneously.

Figure 4:
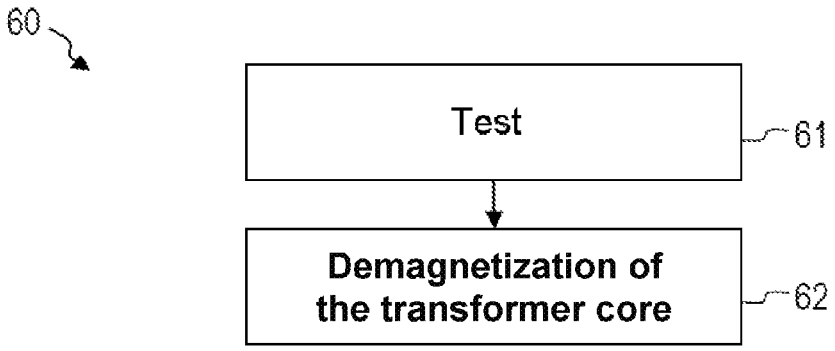
FIG. 4 is a flow diagram of a method according to one exemplary embodiment.

FIG. 4 is a flow diagram of a method 60, which can be executed by a device according to an exemplary embodiment.

In step 61, the testing of a facility on an electricity supply system, for example a switch, can be executed automatically. To this end, a current can be fed into a primary conductor. The test can be executed by the device 40, or by a test apparatus which is separate therefrom. The test can comprise a micro-ohmic measurement, wherein a resistance of the switch in a closed state is measured. At least one secondary side of a transformer is inductively coupled to the primary conductor, in order to constitute a transformer.

In step 62, a transformer core of the transformer is demagnetized. To this end, an alternating signal is generated by the device 40, and is fed into the primary side of the transformer. The alternating signal is varied as a function of time, in order to demagnetize the transformer core, as will be described in greater detail with reference to FIGS. 5 to 13.

The device 40 can be designed such that the test in step 61 and the demagnetization in step 62 can be executed sequentially, without the necessity for the alteration of electrically-conductive connections between the device 40 and the primary side of the transformer for this purpose. Alternatively, a separate test apparatus from the device 40 can be employed for the execution of the test in step 61.

The alternating signal which is generated by the device 40 for the demagnetization of the transformer core can be an alternating current or an alternating voltage. The alternating signal can assume various signal shapes, for example sinusoidal, sawtooth signal, square-wave signal, etc.

The alternating signal can be varied as a function of time, such that a time integral of a magnitude of the alternating signal, determined respectively between times which correspond to sequential polarity reversals of the alternating signal, decreases as a function of time. The alternating signal can be varied as a function of time, such that a time integral of a magnitude of the alternating signal, determined respectively between times which correspond to sequential polarity reversals of the alternating signal, decreases monotonically as a function of time.

Figure 5:
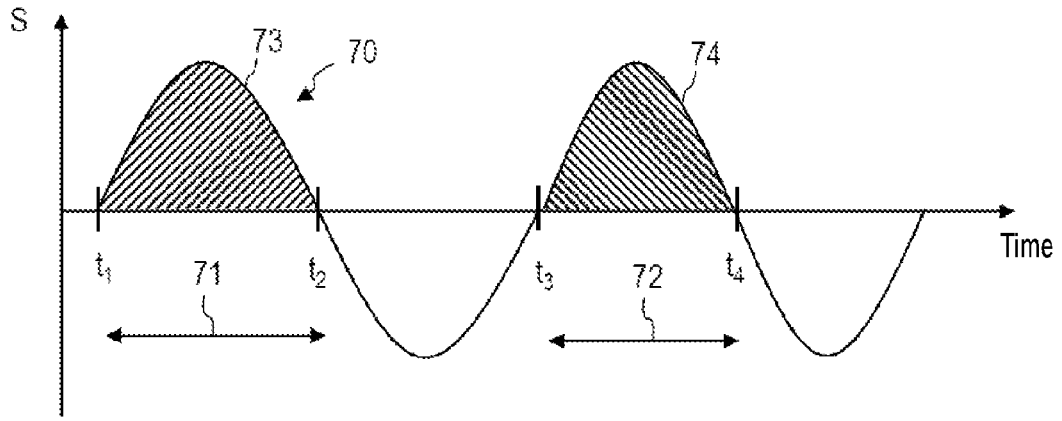
FIG. 5 shows an alternating signal, which is generated by devices and methods according to exemplary embodiments for the demagnetization of a transformer core.

FIG. 5 shows an alternating signal 70, which can be generated by the device 40 for the demagnetization of the transformer core. The alternating signal can, for example, be sinusoidal or essentially sinusoidal. A frequency of the alternating signal is increased as a function of time.

A duration 71 between times $t_1$, $t_2$, at which sequential polarity reversals of the alternating signal 70 occur, can be longer than a duration 72 between further times $t_3$, $t_4$, at which further sequential polarity reversals of the alternating signal 70 occur, wherein at least one of the further times $t_3$, $t_4$ is later than the time $t_2$.

The period between sequential polarity reversals must not be reduced between each cycle. A plurality of cycles of the same duration 71 can also be provided.

The device 40 can be designed such that the duration between sequential polarity reversals of the alternating signal 70 decreases monotonically as a function of time. The duration can, but must not necessarily show a strict monotonic reduction with time.

A time integral 74 of the magnitude of the alternating signal between the further times $t_3$, $t_4$, due to the frequency increase, is smaller than a time integral 73 of the magnitude of the alternating signal between the times $t_1$, $t_2$, wherein at least one of the further times $t_3$, $t_4$ is later than the time $t_2$.

The device 40 can be designed such that the time integral of the magnitude of the alternating signal, determined between sequential polarity reversals of the alternating signal 70, decreases monotonically as a function of time. The time integral can, but must not necessarily show a strict monotonic reduction with time.

Figure 6:
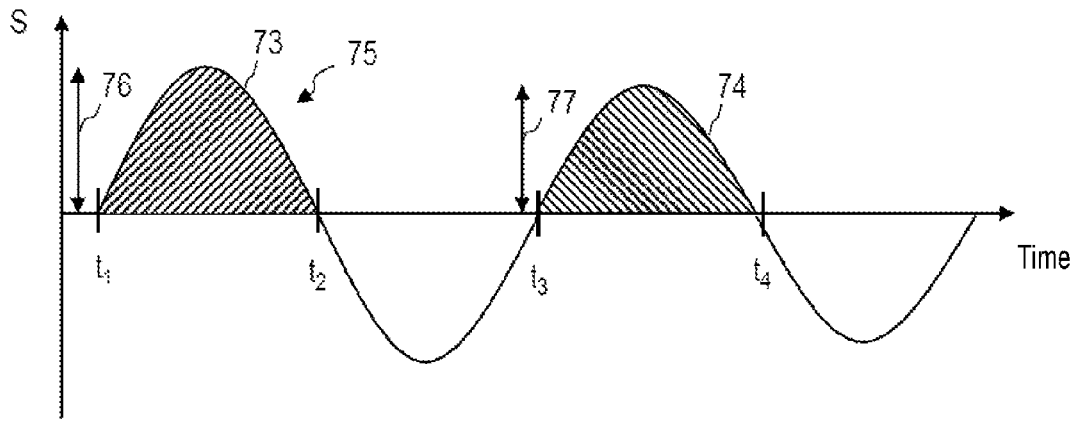
FIG. 6 shows an alternating signal, which is generated by devices and methods according to exemplary embodiments for the demagnetization of a transformer core.

FIG. 6 shows an alternating signal 75, which can be generated by the device 40 for the demagnetization of the transformer core. The alternating signal can, for example, be sinusoidal or essentially sinusoidal. An amplitude of the alternating signal is decreased as a function of time.

An amplitude 76 of a cycle of the alternating signal 75 between times $t_1$, $t_2$ can be greater than an amplitude 77 between further times $t_3$, $t_4$, wherein at least one of the further times $t_3$, $t_4$ is later than the time $t_2$.

The amplitude must not be reduced between each cycle. The alternating signal 75 can also have a plurality of cycles of the same amplitude 76.

The device 40 can be designed such that the amplitude of the alternating signal 75 decreases monotonically as a function of time. The amplitude can, but must not necessarily show a strict monotonic reduction with time.

A time integral 74 of the magnitude of the alternating signal between the further times $t_3$, $t_4$, due to the amplitude reduction, is smaller than the time integral 73 of the magnitude of the alternating signal between the times $t_1$, $t_2$, wherein at least one of the further times $t_3$, $t_4$ is later than the time $t_2$.

The device 40 can be designed such that the time integral of the magnitude of the alternating signal, determined between sequential polarity reversals of the alternating signal 75, due to the amplitude reduction, decreases monotonically as a function of time. The time integral can, but must not necessarily show a strict monotonic reduction with time.

Figure 7:
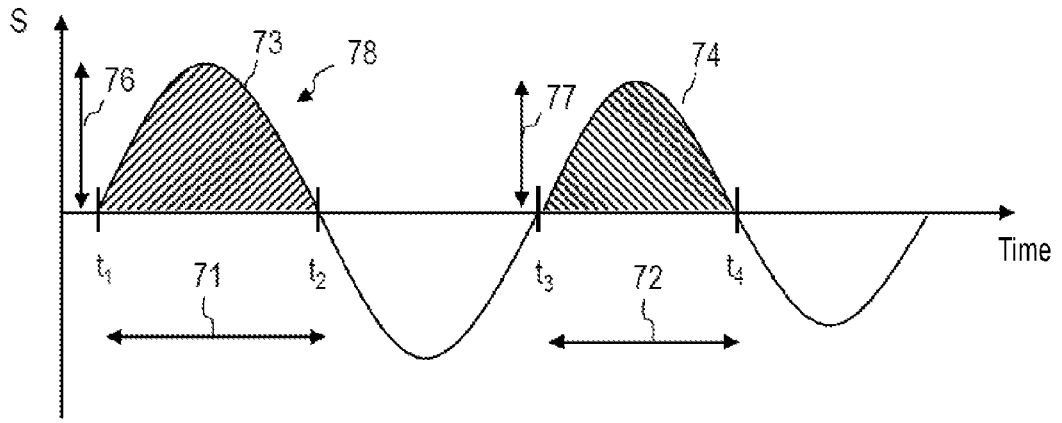
FIG. 7 shows an alternating signal, which is generated by devices and methods according to exemplary embodiments for the demagnetization of a transformer core.

FIG. 7 shows an alternating signal 78, which can be generated by the device 40 for the demagnetization of the transformer core. The alternating signal can, for example, be sinusoidal or essentially sinusoidal. Herein, both a time-dependent frequency increase and a time-dependent amplitude reduction occur, as described with reference to FIG. 5 and FIG. 6.

The device 40 can be designed such that the amplitude of the alternating signal 78 decreases monotonically as a function of time, and the frequency of the alternating signal 78 increases monotonically as a function of time. The frequency can, but must not necessarily show a strict monotonic increase with time. The amplitude can, but must not necessarily show a strict monotonic decrease with time.

A time integral 74 of the magnitude of the alternating signal between the further times $t_3$, $t_4$, due to the amplitude reduction and the frequency increase, is smaller than a time integral 73 of the magnitude of the alternating signal between the times $t_1$, $t_2$, wherein at least one of the further times $t_3$, $t_4$ is later than the time $t_2$.

The device 40 can be designed such that the time integral of the magnitude of the alternating signal, determined between sequential polarity reversals of the alternating signal 78, due to the amplitude reduction and the frequency increase, decreases monotonically as a function of time. The time integral can, but must not necessarily show a strict monotonic reduction with time.

Figure 8:
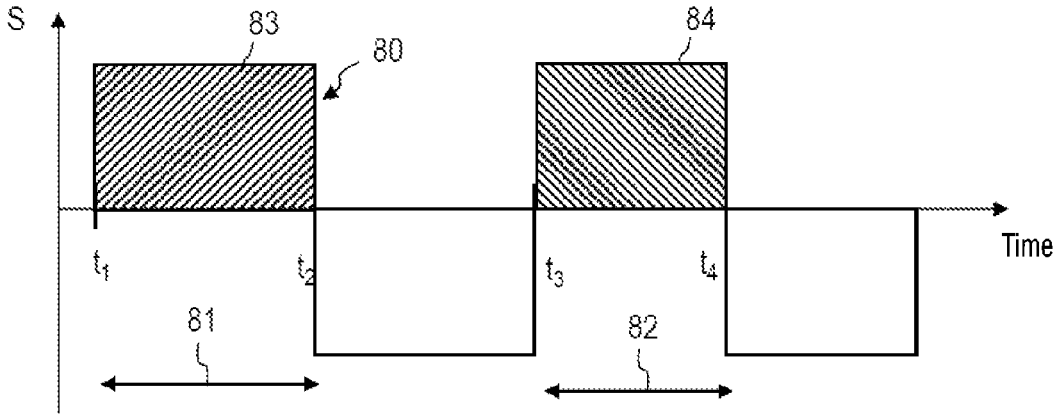
FIG. 8 shows an alternating signal, which is generated by devices and methods according to exemplary embodiments for the demagnetization of a transformer core.

FIG. 8 shows an alternating signal 80 which can be generated by the device 40 for the demagnetization of the transformer core. The alternating signal can, for example, be an alternating direct-component signal, which assumes the form of a square-wave signal with alternating polarities. A frequency of the alternating signal is increased as a function of time.

A duration 81 between times $t_1$, $t_2$, at which sequential polarity reversals of the alternating signal 80 occur, can be longer than a duration 82 between further times $t_3$, $t_4$, at which further sequential polarity reversals of the alternating signal 80 occur, wherein at least one of the further times $t_3$, $t_4$ is later than the time $t_2$.

The period between sequential polarity reversals must not be reduced between each cycle. A plurality of cycles of the same duration 81 can also be provided.

The device 40 can be designed such that the duration between sequential polarity reversals of the alternating signal 80 decreases monotonically as a function of time. The time interval can, but must not necessarily show a strict monotonic reduction with time.

A time integral 84 of the magnitude of the alternating signal between the further times $t_3$, $t_4$, due to the frequency increase, is smaller than a time integral 83 of the magnitude of the alternating signal between the times $t_1$, $t_2$, wherein at least one of the further times $t_3$, $t_4$ is later than the time $t_2$.

The device 40 can be designed such that the time integral of the magnitude of the alternating signal, determined between sequential polarity reversals of the alternating signal 80, decreases monotonically as a function of time. The time integral can, but must not necessarily show a strict monotonic reduction with time.

Figure 9:
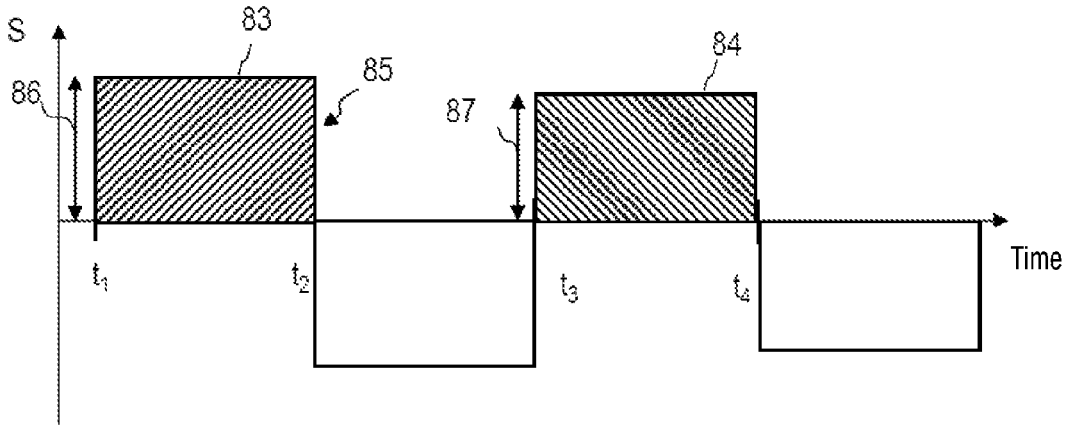
FIG. 9 shows an alternating signal, which is generated by devices and methods according to exemplary embodiments for the demagnetization of a transformer core.

FIG. 9 shows an alternating signal 85, which can be generated by the device 40 for the demagnetization of the transformer core. The alternating signal can, for example, be an alternating direct-component signal, which assumes the form of a square-wave signal with alternating polarities. An amplitude of the alternating signal decreases as a function of time.

An amplitude 86 of a cycle of the alternating signal 85 between times $t_1$, $t_2$ can be greater than an amplitude 87 between further times $t_3$, $t_4$, wherein at least one of the further times $t_3$, $t_4$ is later than the time $t_2$.

The amplitude must not be reduced between each cycle. The alternating signal 85 can also have a plurality of cycles of the same amplitude 86.

The device 40 can be designed such that the amplitude of the alternating signal 85 decreases monotonically as a function of time. The amplitude can, but must not necessarily show a strict monotonic reduction with time.

A time integral 84 of the magnitude of the alternating signal between the further times $t_3$, $t_4$, due to the amplitude reduction, is smaller than a time integral 83 of the magnitude of the alternating signal between the times $t_1$, $t_2$, wherein at least one of the further times $t_3$, $t_4$ is later than the time $t_2$.

The device 40 can be designed such that the time integral of the magnitude of the alternating signal, determined between sequential polarity reversals of the alternating signal 85, due to the amplitude reduction, decreases monotonically as a function of time. The time integral can, but must not necessarily show a strict monotonic reduction with time.

Figure 10:
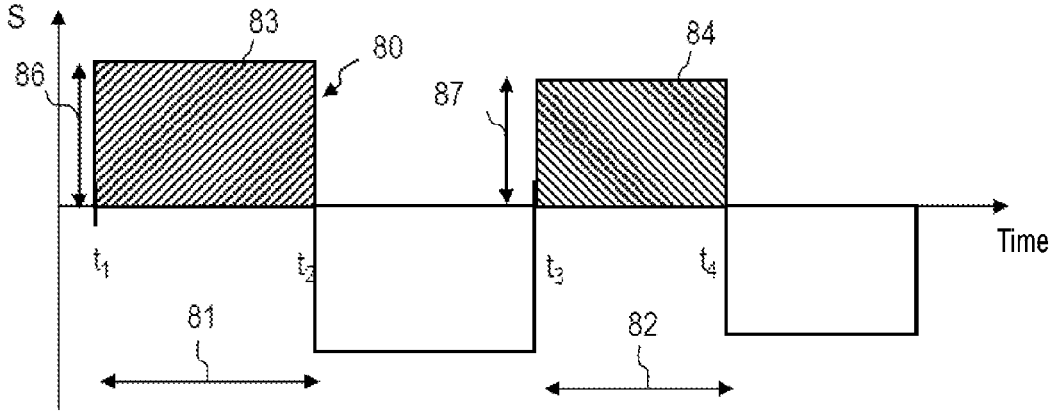
FIG. 10 shows an alternating signal, which is generated by devices and methods according to exemplary embodiments for the demagnetization of a transformer core.

FIG. 10 shows an alternating signal 88, which can be generated by the device 40 for the demagnetization of the transformer core. The alternating signal can, for example, be an alternating direct-component signal, which assumes the form of a square-wave signal with alternating polarities. Herein, both a time-dependent frequency increase and a time-dependent amplitude reduction occur, as described with reference to FIG. 8 and FIG. 9.

The device 40 can be designed such that the amplitude of the alternating signal 88 decreases monotonically as a function of time, and the frequency of the alternating signal 88 increases monotonically as a function of time. The frequency can, but must not necessarily show a strict monotonic increase with time. The amplitude can, but must not necessarily show a strict monotonic decrease with time.

A time integral 84 of the magnitude of the alternating signal between the further times $t_3$, $t_4$, due to the amplitude reduction and the frequency increase, is smaller than a time integral 83 of the magnitude of the alternating signal between the times $t_1$, $t_2$, wherein at least one of the further times $t_3$, $t_4$ is later than the time $t_2$.

The device 40 can be designed such that the time integral of the magnitude of the alternating signal, determined between sequential polarity reversals of the alternating signal 88, due to the amplitude reduction and the frequency increase, decreases monotonically as a function of time. The time integral can, but must not necessarily show a strict monotonic reduction with time.

Regardless of the specific implementation of the signal shape, the device 40 can be designed to determine times at which the alternating signal is varied, and/or the manner in which the alternating signal is varied, in accordance with a response of the transformer to the alternating signal. To this end, the evaluation device can detect the response of the transformer. The response can be detected on the primary conductor 11. If the secondary sides of a plurality of transformers are connected to the primary conductor 11, the response of the plurality of transformers to the alternating signal can be detected on the primary conductor 11.

Depending upon the response of the transformer or transformers to the alternating signal, it can be determined when the amplitude and/or the frequency of the alternating signal is varied. Alternatively or additionally, depending on the response of the transformer or transformers to the alternating signal, the magnitude by which the amplitude and/or the frequency of the alternating signal is varied can be determined. By the consideration of the response of the transformer or the plurality of transformers to the alternating signal, demagnetization can be executed in a particularly effective manner.

Figure 11:
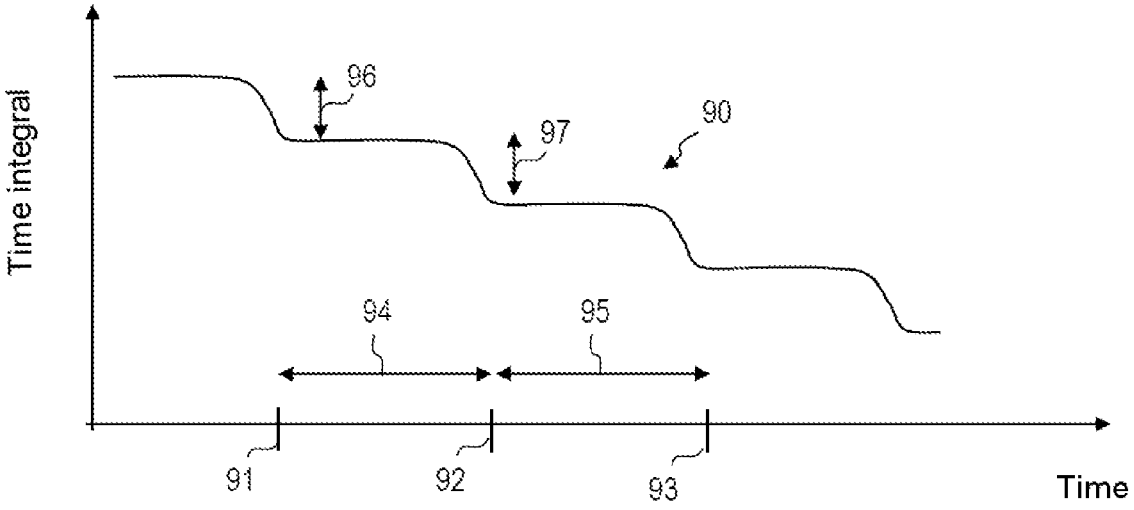
FIG. 11 shows a diagram for the illustration of the mode of operation of devices and methods according to exemplary embodiments.

FIG. 11 shows how the time integral of the magnitude of the alternating signal, determined respectively between two sequential polarity reversals of the alternating signal, can be varied by the device 40 as a function of time. Time points 91, 92, 93, at which the alternating signal is varied can be determined automatically by the device 40, in accordance with the response of the transformer or the plurality of transformers to the alternating signal. Durations 94, 95 for which the amplitude and/or frequency of the alternating signal remain unchanged respectively, can be determined automatically by the device 40, in accordance with the response of the transformer or the plurality of transformers to the alternating signal. Variations 96, 97 in the time integral, the frequency and/or the amplitude of the alternating signal can be determined automatically by the device 40, in accordance with the response of the transformer or the plurality of transformers to the alternating signal.

Alternatively or additionally, the device 40 can also be designed, according to the response of the transformer or the plurality of transformers to the alternating signal, to detect that the transformer core or transformer cores require no further demagnetization. The feeding of the alternating signal for the purpose of demagnetization can thus be terminated, depending on the response of the transformer of the plurality of transformers to the alternating signal.

Figure 12:
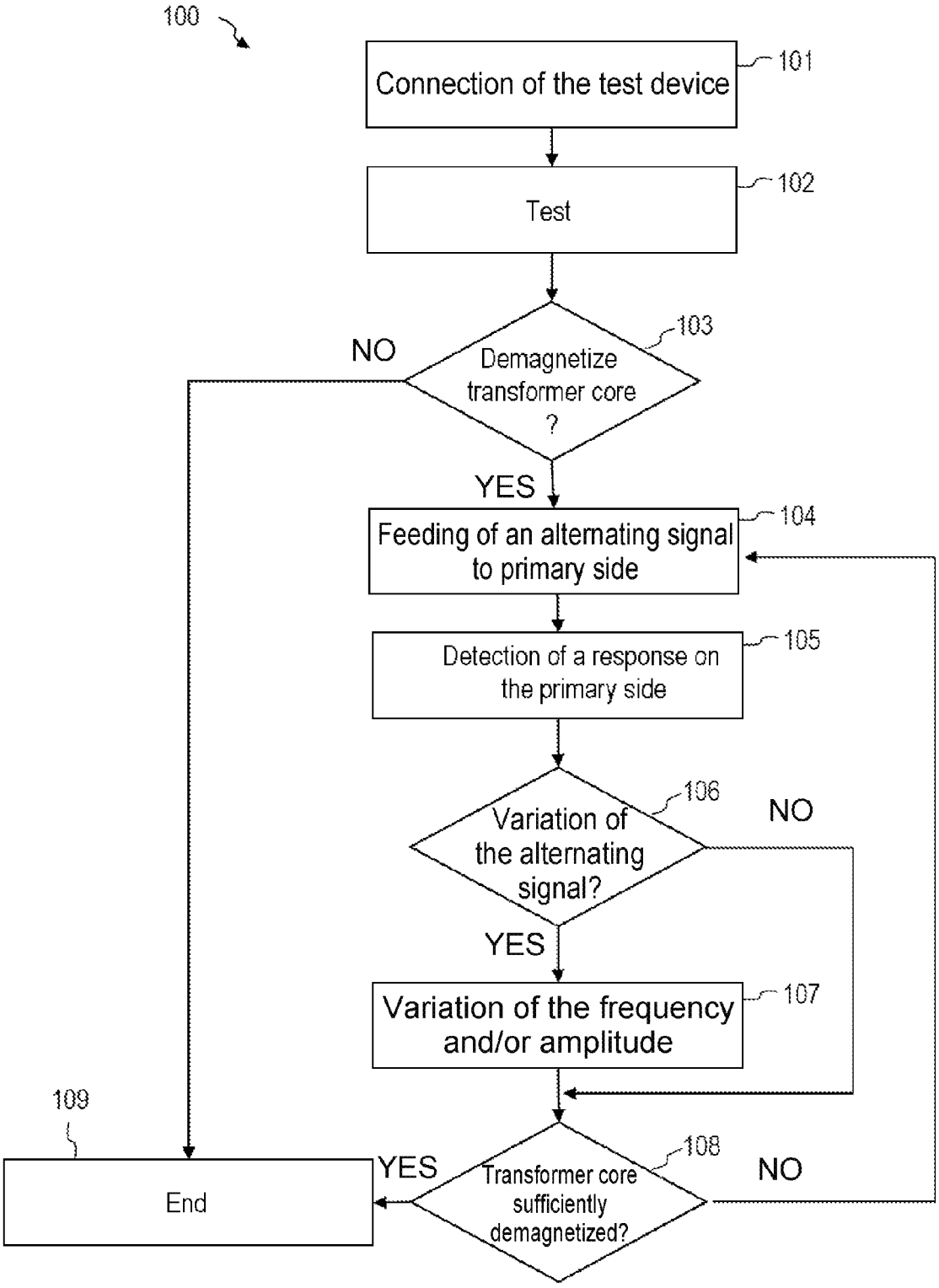
FIG. 12 is a flow diagram of a method according to one exemplary embodiment.

FIG. 12 is a flow diagram of a method 100 according to an exemplary embodiment. The method 100 can be executed automatically by the device 40.

In step 101, a device 40 is detachably connected to a component of an electricity supply system or an electricity generating system. The component can be a switch, for example a dead-tank circuit-breaker, or another unit of the primary system of the electricity supply system or electricity generating system.

Testing of the component is executed in step 102. The test can comprise a resistance measurement of a switch in the closed state. The test can be executed as a micro-ohmic measurement. During the test, a current, specifically a direct current, flows through a primary conductor of a transformer. The current can be delivered by the device 40 and fed into the primary conductor. The transformer has a transformer core, through which the primary conductor can be routed. The transformer has a secondary winding, which can be wound onto the transformer core. In other configurations, the test in step 102 can be executed using a test apparatus which is separate from the device 40.

In step 103, a check is executed as to whether a transformer core requires demagnetization. The check executed in step 103 can include monitoring by the device 40 of whether demagnetization has been triggered by a user input on a user interface of the device 40. The check executed in step 103 can include the detection of a type of component tested. Depending on the type of component tested, demagnetization can be executed automatically or otherwise. For example, demagnetization can be executed automatically for one type of tested component, for example a TPX core. Information on the relevant configuration of the component can be saved in a non-volatile manner of the device 40. Via a user interface, the user can enter the component to which the device 40 is connected. Depending on this input, and on the information saved in a memory of the device 40, demagnetization can be executed automatically or otherwise. If the transformer core is not to be demagnetized, as might be the case, for example, for a TPZ core, the method can end at step 109.

In step 104, for the demagnetization of the transformer core, an alternating signal is generated by the device 40. The alternating signal is fed to the primary side of the transformer. The alternating signal can be fed, with no alteration of the connections between the device 40 and the component of the electricity supply system or electricity generating system being necessary, between the test executed in step 103 and the demagnetization executed in steps 104 to 108.

In step 105, a response of the transformer to the alternating signal can be detected. The response can be detected on the primary side of the transformer. If a plurality of transformers are present, the secondary windings of which are inductively coupled to the same primary conductor, the response of the plurality of transformers to the alternating signal can be detected. The response can be detected on the primary side. The response can be detected, without the requirement for the formation of a connection with the secondary winding of one of the transformers, for the purposes of the detection of the response.

In step 106, depending on the response, a check is executed as to whether the alternating signal is to be varied. The check executed in step 106 can comprise a threshold value comparison of the response detected, or of a characteristic value derived therefrom, with one or more threshold values. The check can include that, depending upon the response detected, a magnetization of the transformer core or transformer cores is determined. To this end, for example, a phase displacement between the alternating signal and the response can be determined. Depending on the magnetization, it can be determined whether the alternating signal is to be varied. If the alternating signal is not to be varied, the method proceeds to step 108.

In step 107, the alternating signal is varied if, in step 106, it is determined that variation of the alternating signal is required. A time point at which the alternating signal is varied, depending on the response detected in step 105, can be determined. Alternatively or additionally, depending on the response detected in step 105, the magnitude by which an amplitude of the alternating signal is to be varied can be determined. Alternatively or additionally, depending on the response detected in step 105, the magnitude by which a frequency of the alternating signal is to be varied can be determined.

In step 108, a check is executed as to whether the transformer core is sufficiently demagnetized. It is not necessary for the transformer core to be completely demagnetized. An abort criterion can be checked, which confirms, for example, that fault currents are reliably detected by protective transformers. The abort criterion can comprise an evaluation of the response detected in step 105. The abort criterion can be selected such that a threshold value for the integral of the signal is achieved or undershot. If the transformer core is not yet sufficiently demagnetized, the method returns to step 104. If the abort criterion is fulfilled, the method can be terminated at step 109.

The device can then again be disconnected from the component of the electricity supply system or electricity generating system.

Figure 13:
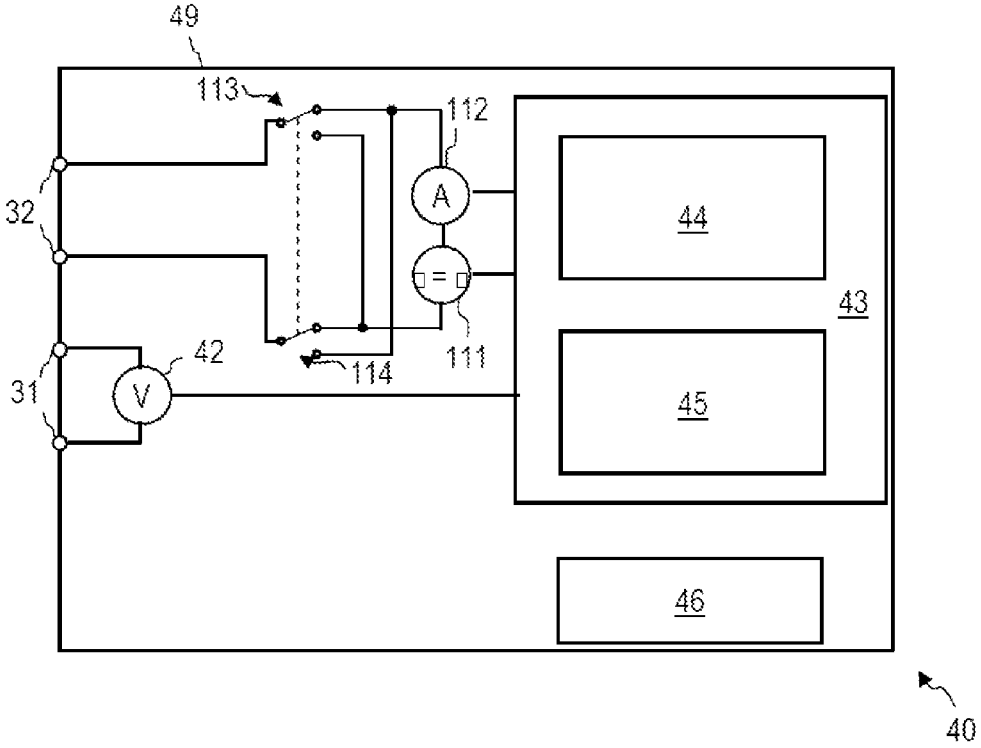
FIG. 13 is a block diagram of a device according to one exemplary embodiment.

FIG. 13 is a block representation of a device 40 according to one exemplary embodiment. The device 40 can comprise a direct current source 111. The direct current source 111 can be controlled, such that a resistance measurement or another test is executed on a component of an electricity supply system or an electricity generating system. A voltage can be detected using a voltmeter 42. An ammeter 112 can be connected in series with the direct current source 111, or incorporated in the direct current source 111. An output signal of the ammeter 112 can be employed for a current regulation of the output current of the direct current source 111.

For the generation of the alternating signal, a first controllable switch 113 and a second controllable switch 114 can be provided. The first controllable switch 113 and the second controllable switch 114, under the control of the control device 44, can be operated such that a polarity of the current at the outputs 32 alternates. In this manner, the alternating signal can be generated as an alternating direct-component signal.

In the device 40 of FIG. 13, the combination of direct current source 111 with the controllable switches 113, 114, which are connected in a synchronized manner, acts as the source for the alternating signal.

Other configurations for the source of the alternating signal are possible. For example, a current or voltage source can be employed which is controllable, such that it can function optionally as a direct-component signal source or as an alternating signal source.

The source of the alternating signal can be integrated in a housing 49 of the device 40. The device 40 can incorporate a user interface 46. Via the user interface 46, a user can determine whether a demagnetization of a transformer core or of a plurality of transformer cores is to be executed. Via the user interface 46, a user can enter inputs which are automatically evaluated by the device 40, in order to determine whether a demagnetization of a transformer core, or of a plurality of transformer cores, is to be executed.

Although exemplary embodiments have been described in detail with reference to the figures, alternative or additional characteristics can be employed in further exemplary embodiments. Although, for example, the employment of a device in combination with a switch in a power plant or in an electricity supply system has been described, the devices and methods according to exemplary embodiments can also be employed for other components.

Although, in the exemplary embodiments, a demagnetization procedure, comprising the feeding of an alternating signal to the primary side, can be executed automatically, the device and the method according to exemplary embodiments can also be employed where demagnetization is executed separately from a testing of the component of the power plant or electricity supply system.

Although, in the exemplary embodiments, a response of the transformer to the alternating signal on the primary side can be detected, it is also possible for the response to be detected on the secondary side.

Devices, methods and systems according to exemplary embodiments reduce the risk that fault currents will not be reliably detected, further to testing of a component of a power plant or electricity supply system.

The invention claimed is:

1. A demagnetization device, comprising:

terminals for the detachable connection of the demagnetization device to a primary side of a transformer;

a source, which is designed, for the demagnetization of a transformer core of the transformer, to feed an alternating signal to the primary side of the transformer via the terminals; and a measuring device for the detection of a response of the transformer to the alternating signal, wherein the demagnetization device is designed to control the source so as to vary a frequency or an amplitude of the alternating signal in accordance with the response detected by the measuring device, and wherein the demagnetization device is configured to compare the response detected by the demagnetization device, or a characteristic value thereof, with at least one threshold value, and vary the frequency or the amplitude of the alternating signal based a result of the comparison of the response with the threshold value.

2. The demagnetization device as claimed in claim 1, wherein the demagnetization device is designed, for the demagnetization of the transformer core, to reduce the amplitude of the alternating signal as a function of time, or to increase the frequency of the alternating signal as a function of time.

3. The demagnetization device as claimed in claim 1, wherein the demagnetization device is designed, for the demagnetization of the transformer core, to generate the alternating signal such that a time integral of a magnitude of the alternating signal determined between two times, at which two sequential polarity reversals of the alternating signal are executed, is varied as a function of time.

4. The demagnetization device as claimed in claim 3, wherein the demagnetization device is designed, for the demagnetization of the transformer core, to generate the alternating signal such that the time integral decreases.

5. The demagnetization device as claimed in claim 1, further comprising a measuring device for the detection of a response of the transformer and of at least one further transformer, which share a common primary conductor, to the alternating signal.

6. The demagnetization device as claimed in claim 1, wherein the demagnetization device is designed to detect the demagnetization of the transformer core in accordance with the response detected by the measuring device.

7. The demagnetization device as claimed in claim 1, wherein the measuring device, for the detection of the response, is connectable to the primary side of the transformer.

8. The demagnetization device as claimed in claim 1, wherein the demagnetization device is designed for the execution of a resistance measurement on the primary side of the transformer and, for the demagnetization of the transformer core further to the completion of the resistance measurement, for the infeed of the alternating signal to the primary side of the transformer.

9. A system, comprising:

a transformer, having a primary side, a secondary side and a transformer core, and the demagnetization device as claimed in claim 1.

10. The system as claimed in claim 9, wherein the demagnetization device is only connected to the primary side of the transformer.

11. The system as claimed in claim 9, wherein the transformer is a bushing-type current transformer of a dead-tank circuit-breaker.

12. A method for the demagnetization of a transformer core of a transformer, comprising:

connecting a demagnetization device to a primary side of the transformer; and demagnetizing the transformer core of the transformer, wherein the demagnetizing of the transformer core comprises:

generating an alternating signal by the demagnetization device and feeding the alternating signal to the primary side of the transformer;

detecting a response to the alternating signal; and controlling the source so as to vary a frequency or an amplitude of the alternating signal according to the response detected, and wherein the demagnetization device is configured to compare the response detected by the demagnetization device, or a characteristic value thereof, with at least one threshold value, and vary the frequency or the amplitude of the alternating signal based a result of the comparison of the response with the threshold value.

13. The method as claimed in claim 12, wherein, for the demagnetizing of the transformer core, the amplitude of the alternating signal is reduced as a function of time or the frequency of the alternating signal is increased as a function of time.

14. The method as claimed in claim 12, wherein the alternating signal is an alternating current, and the response comprises a voltage.

15. The method as claimed in claim 12, wherein the alternating signal is an alternating voltage, and the response comprises a current.

16. The method as claimed in claim 12, wherein the demagnetization device is only connected to the primary side of the transformer.

17. The method as claimed in claim 12, wherein the transformer is a bushing-type current transformer of a dead-tank circuit-breaker.

18. The method as claimed in claim 12, wherein the transformer is a protective transformer.

* * * * *